US006661383B2

(12) United States Patent
Sakurai et al.

(10) Patent No.: US 6,661,383 B2
(45) Date of Patent: Dec. 9, 2003

(54) HELICAL ANTENNA AND PORTABLE COMMUNICATION TERMINAL

(75) Inventors: Minoru Sakurai, Tokyo (JP); Masanobu Shimanuki, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/201,929

(22) Filed: Jul. 25, 2002

(65) Prior Publication Data

US 2003/0020660 A1 Jan. 30, 2003

(30) Foreign Application Priority Data

Jul. 26, 2001 (JP) ..... 2001-226472

(51) Int. Cl.[7] ..... H01Q 1/24
(52) U.S. Cl. ..... 343/702; 343/895
(58) Field of Search ..... 343/702, 789, 343/895, 900

(56) References Cited

U.S. PATENT DOCUMENTS 6,052,090 A * 4/2000 Simmons et al. ..... 343/702
6,229,488 B1 * 5/2001 Lin et al. ..... 343/700 MS
6,348,900 B1 * 2/2002 Blom ..... 343/895
6,448,934 B1 * 9/2002 Lee et al. ..... 343/702
6,452,555 B1 * 9/2002 Chang et al. ..... 343/702
6,563,476 B1 * 5/2003 Sheng-Gen et al. ..... 343/895

FOREIGN PATENT DOCUMENTS

JP 10-107526 4/1998
JP 2001-127517 5/2001

* cited by examiner

*Primary Examiner*—Hoang V. Nguyen
*Assistant Examiner*—Shih-Chao Chen
(74) *Attorney, Agent, or Firm*—Oblon, Spivak, McClelland, Maier & Neustadt, P.C.

(57) ABSTRACT

In a helical antenna for use in a portable communication terminal containing a radio unit which transmits and receives a radio signal, an antenna element is connectable to the radio unit, and contains a bottom portion formed into a helical portion and a top portion formed into a linear portion, the linear portion being positioned along a screw axis of the helical portion. A cap houses the antenna element if the cap covers the antenna element from a top end of the antenna element. A position portion is provided in the cap and positions the linear portion of the antenna element along the screw axis of the helical portion. By virtue of this structure, an appropriate distance can be reliably secured between the antenna element and a human body, thereby maintaining a good characteristic of the antenna.

18 Claims, 6 Drawing Sheets

HELICAL ANTENNA AND PORTABLE COMMUNICATION TERMINAL

CROSS-REFERENCE TO RELATED APPLICATIONS

This application is based upon and claims the benefit of priority from the prior Japanese Patent Application No. 2001-226472, filed Jul. 26, 2001, the entire contents of which are incorporated herein by reference.

BACKGROUND OF THE INVENTION

1. Field of the Invention

The present invention relates to a helical antenna for a portable communication terminal such as a portable phone or personal digital assistant, etc., and also to a portable communication terminal with the helical antenna.

2. Description of the Related Art

A helical antenna is often used for a portable phone or personal digital assistant. FIG. 11 shows an example of a conventional helical antenna.

As shown, the conventional helical antenna is formed by attaching a helical antenna element 22 to a metal element holder 21, and covering the helical antenna element 22 with a cap 23 made of resin. The antenna is formed unitedly with a portable terminal casing 1 by an antenna holder 11. The metal element holder 21 enables the transmission of a radio signal between the antenna element 22 and the radio circuit incorporated in the portable terminal casing 1. Since a helical antenna can be easily downsized, the helical antenna is very suitable for portable communication terminals whose downsizing and thinning is a most important object.

Since, however, the helical antenna is used fixed to the portable terminal casing 1, it is possible that the helical antenna will be brought into contact with an ear of a user during a call. Because of recent developments in downsizing and thinning of portable communication terminals, the helical antenna has come to be more liable to be brought into contact with an ear of a user. Where the helical antenna is in contact with an ear of a user, the characteristic of the helical antenna is degraded.

FIG. 12A and FIG. 12B illustrate changes in the characteristic of the antenna due to a human body. FIG. 12A shows the characteristic of the antenna assumed that an ear of a user does not touch the helical antenna. FIG. 12B shows the characteristic of the antenna assumed that an ear of a user touches the helical antenna. As seen from FIG. 12A, where no ear touches the helical antenna, each voltage standing wave ratio (VSWR) is kept at respective desired values at frequencies A, B and C in the radio frequency band that is expected to be used. On the other hand, where an ear of a user touches the helical antenna, the central frequency of the antenna varies as shown FIG. 12B, and hence each of VSWRs corresponding to A, B and C assumes high values at the frequencies A, B and C. This means that the characteristic of the antenna is degraded.

Further, the characteristic of the helical antenna varies in accordance with the distance between a human body and the helical antenna. FIG. 13 shows the result of a simulation concerning the degree of mismatch loss that occurs, in accordance with changes in the central frequency of a helical antenna, when a metal plate is made to be close to the element of the antenna. The metal plate is used because the electrical characteristic of the metal plate has a characteristic similar to that of a human body. As is evident from FIG. 13, the characteristic of the helical antenna is degraded as the distance between the helical antenna element and metal plate is reduced.

To reduce the influence of a human body upon the antenna, Jpn. Pat. Appln. KOKAI Publication No. 10-107526, for example, has proposed an antenna structure in which the antenna is located at a position displaced from the center of the antenna cover (i.e., cap of the antenna) so that the position of the antenna is away from a human body. If this structure is employed, the antenna element can be positioned from an ear of a user at a distance corresponding to the width of the antenna cover, thereby reducing the influence of the body of the user upon the antenna.

However, in general, the portable phone is used with the helical antenna attached to the top end of the rod antenna. Therefore, the helical antenna is rotatable about the rotational axis of the rod antenna on the casing of the phone. This means that while the helical antenna is being used, the antenna element is not always positioned farthest from the body of a user but may be positioned closest to the body. In this state that the antenna element is positioned closest to the body, the antenna element almost touches the ear of the user, and hence the antenna cannot exhibit a desired characteristic of the antenna element.

Jpn. Pat. Appln. KOKAI Publication No. 2001-127517 has proposed another antenna structure. In this structure, the helical element of the helical antenna has a linearly extended top end that reduces the influence of a human body upon the antenna orientation. This structure enables the top end of the antenna element to be always positioned away from an ear of a user by a distance corresponding to the radius of the radiation section (i.e., antenna cover). Thus, the influence of the body of a user can be reduced.

In this structure, however, the antenna element is not fixed in the radiation section, and hence the top end of the antenna element may be vibrated. Accordingly, during a call, the position of the antenna element may vary in the radiation section due to, for example, vibration of the phone, with the result that the distance to the body of a user becomes unstable and hence a good characteristic for the antenna element cannot be maintained. Furthermore, when the radiation section covers the antenna element, there is a possibility that the top end of the antenna element may be pressed against the inner wall of the radiation section and be deformed. Thus, the antenna element cannot always maintain a stable position.

BRIEF SUMMARY OF THE INVENTION

The present invention has been developed in light of the above and aims to provide a helical antenna including an antenna element that can be positioned at a constant distance from the body of a user, and hence can always exhibit a good characteristic for the antenna, and a portable communication terminal using the helical antenna.

To satisfy the aim, according to an aspect of the invention, there is provided a helical antenna for use in a portable communication terminal containing a radio unit which transmits and receives a radio signal, comprising:

- an antenna element connectable to the radio unit and containing a bottom portion formed into a helical portion and a top portion formed into a linear portion, the linear portion being positioned along a screw axis of the helical portion;
- a cap housing the antenna element if the cap covers the antenna element from a top end of the antenna element; and
- a position portion provided in the cap, the position portion positioning the linear portion of the antenna element along the screw axis of the helical portion.

According to another aspect of the invention, there is provided a portable communication terminal comprising:

a portable communication terminal casing which houses a radio transmitting and receiving circuit; and a helical antenna provided at an upper end of the portable communication terminal casing and connected to the radio transmitting and receiving circuit, the helical antenna comprising:

an antenna element containing a bottom portion formed into a helical portion and a top portion formed into a linear portion, the linear portion being positioned along a screw axis of the helical portion;

a cap housing the antenna element if the cap covers the antenna element from a top end of the antenna element; and a position portion provided in the cap, the position portion positioning the linear portion of the antenna element along the screw axis of the helical portion.

According to yet another aspect of the invention, there is provided a helical antenna for use in a portable communication terminal containing a radio unit which transmits and receives a radio signal, comprising:

an antenna element connectable to the radio unit and containing a bottom portion formed into a helical portion and a top portion formed into a linear portion, the linear portion extending to a screw axis of the helical portion;

a cap housing the antenna element; and a position portion provided in the cap, the position portion positioning the linear portion of the antenna element along the screw axis of the helical portion.

According to a further aspect of the invention, there is provided a portable communication terminal comprising:

a portable communication terminal casing which houses a radio transmitting and receiving circuit; and a helical antenna provided at an upper end of the portable communication terminal casing and connected to the radio transmitting and receiving circuit, the helical antenna comprising:

an antenna element containing a bottom portion formed into a helical portion and a top portion formed into a linear portion, the linear portion extending to a screw axis of the helical portion;

a cap housing the antenna element; and a position portion provided in the cap, the position portion positioning the linear portion of the antenna element along the screw axis of the helical portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

DETAILED DESCRIPTION OF THE INVENTION (First Embodiment)

Figure 1A:
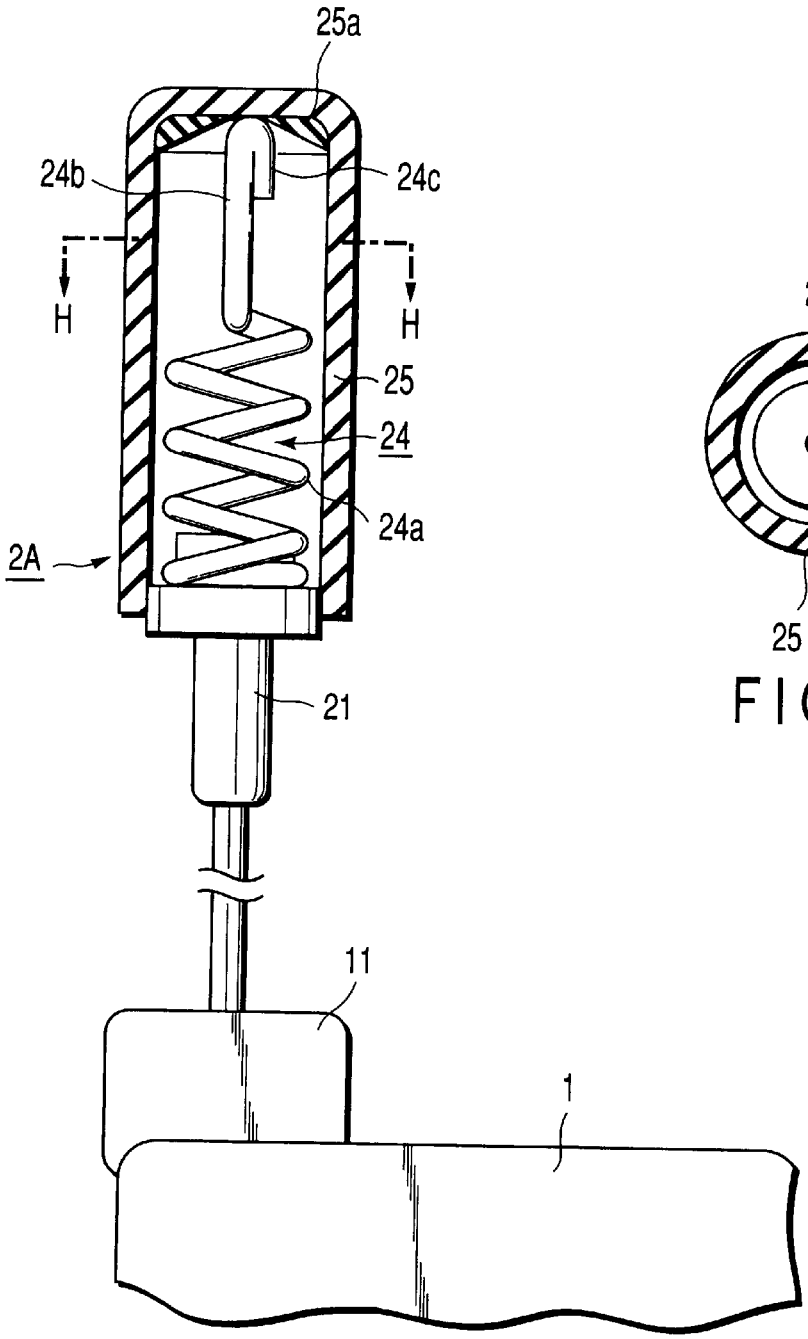
FIG. 1A is a longitudinal cross-section view illustrating a helical antenna according to a first embodiment of the invention.
Figure 1B:
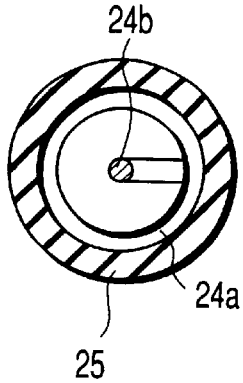
FIG. 1B is a cross-section view taken along line H—H of FIG. 1A.

FIG. 1A is a longitudinal cross-section view illustrating a helical antenna according to a first embodiment of the invention. FIG. 1B is a cross-section view taken along line H—H of FIG. 1A.

The helical antenna 2A according to this embodiment comprises a metal element holder 21, helical antenna element (hereinafter referred to as an "antenna element") 24 attached to the holder 21, and resin molded cap (hereinafter referred to as a "cap") 25.

The metal element holder 21 is connected to a radio circuit in a portable terminal casing 1 via a feed terminal (not shown), thereby electrically connecting the radio circuit to the antenna element 24.

The antenna element 24 has a helical portion 24*a*, a linear portion 24*b* extending from the helical portion 24*a* along a screw axis of the helix, and a bent portion 24*c* formed by bending the top end of the linear portion 24*b*.

The cap 25 has a cylindrical body with a closed upper end and open lower end. The upper inner surface portion of the cylindrical body is formed into an inclined portion (conical portion) 25*a*. The inclined portion 25*a* is tapered toward a central portion of a top of the cap. This portion 25*a* serves to guide the linear top end of the antenna element 24 to the center of the upper inner surface portion of the cap 25, and to hold the linear top end of the antenna element 24 on the center, when the cap 25 covers the antenna element 24.

It may seem that the lower end of the cap 25 is closed, when looking at FIG. 1A. Actually, however, both the inner surface of the cap 25 and outer surface of the element holder 21 are threaded. In other words, the cap 25 and element holder 21 serve as female and male threads, respectively.

By virtue of this structure, when the cap 25 covers the antenna element 24, the top end of the antenna element 24 is guided to the center of the upper inner surface portion of the cap along the conical portion 25*a* of the cap 25, and is held on the center of the cap.

Figure 2:
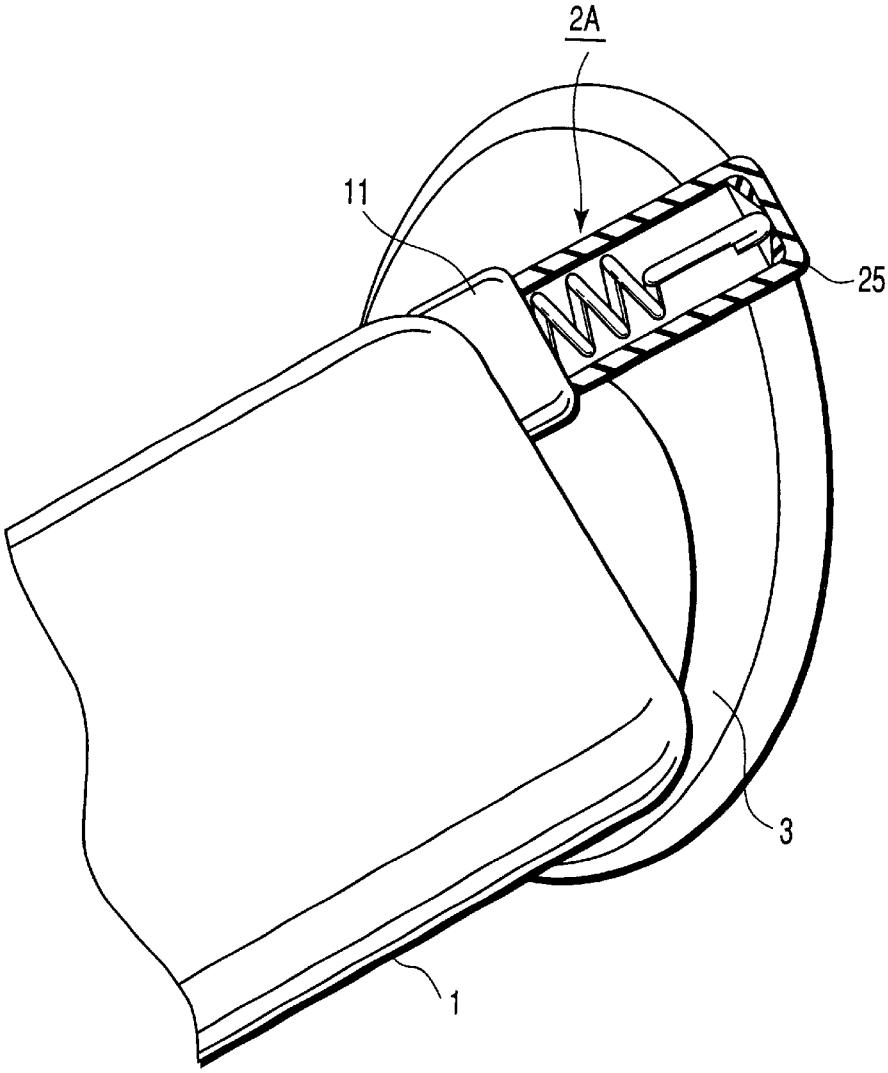
FIG. 2 is a perspective view illustrating an example of a state in which an ear of a user touches a portable phone equipped with the helical antenna shown in FIGS. 1A and 1B.
Figure 4:
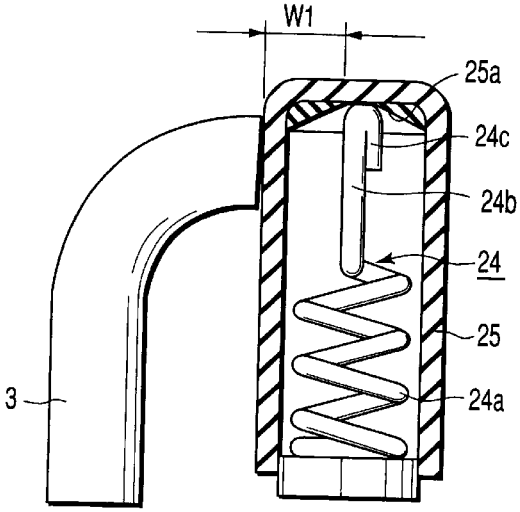
FIG. 4 is a longitudinal cross-section view illustrating the distance between an ear of a user and the antenna element incorporated in the helical antenna of FIGS. 1A and 1B.

Thus, when the cap 25 covers, the linear portion 24*b* of the antenna element 24 is accurately positioned in the center of the cap 25 and held there in a reliable manner. Therefore, even if a user makes a call with the cap 25 of the helical antenna element 2A kept in contact with an ear 3 of the user as shown in FIG. 2, the linear portion 24*b* of the antenna element 24 can be always kept away from the ear 3 of the user by a distance WI that corresponds to the radius of the cap 25, as is shown in FIG. 4. Further, there is little possibility of a change in the position of the antenna element 24 within the cap 25 due to, for example, vibration of the portable terminal casing 1. Thus, the influence of the body of a user upon the antenna element 24 is minimized, thereby maintaining a good characteristic of the antenna.

Figure 3:
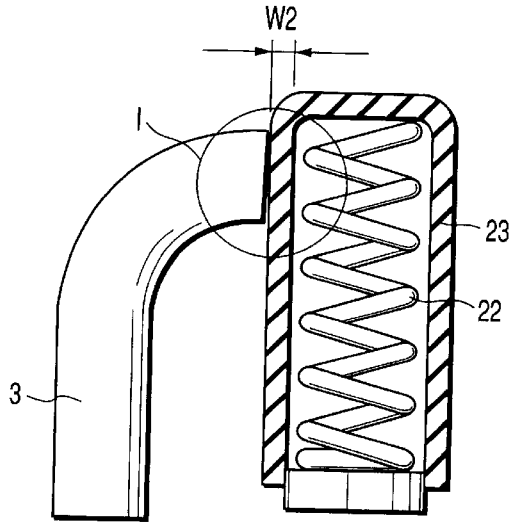
FIG. 3 PRIOR ART
FIG. 3 is a longitudinal cross-section view illustrating the distance between an ear of a user and antenna element incorporated in a conventional helical antenna.
Figure 11:
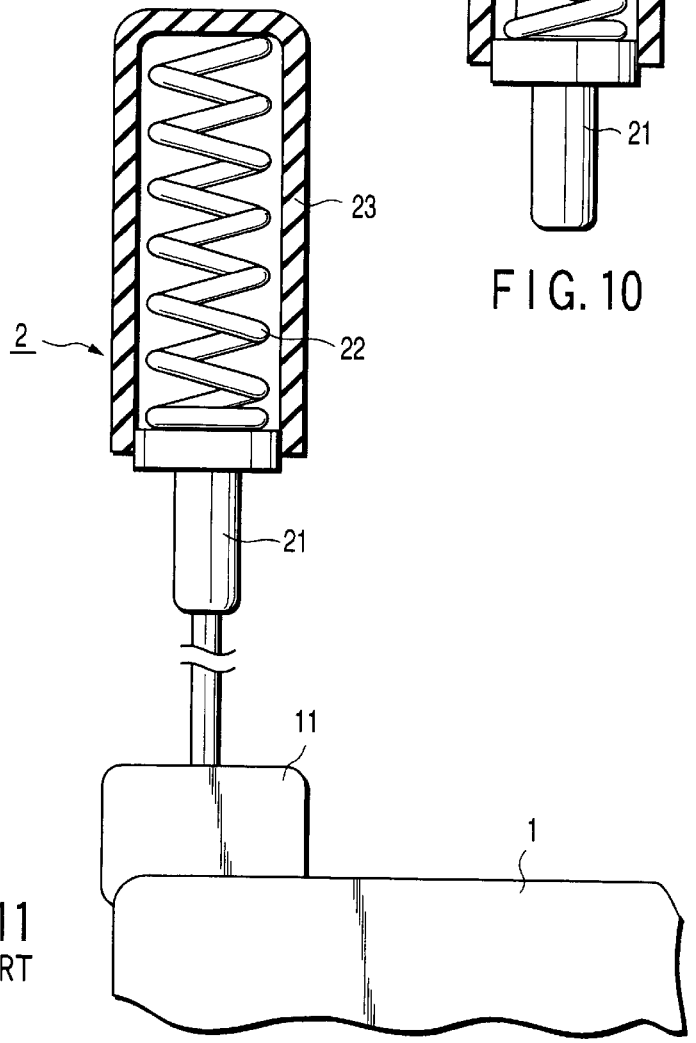
FIG. 11 PRIOR ART
FIG. 11 is a longitudinal cross-section view showing an example of a conventional helical antenna.
Figure 12A:
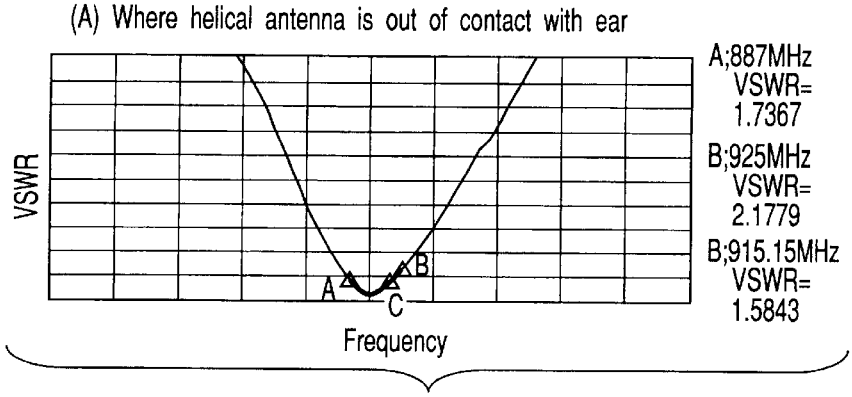
FIG. 12A is a graph indicating the VSWR characteristic assumed that a helical antenna does not touch the ear of a user.
Figure 12B:
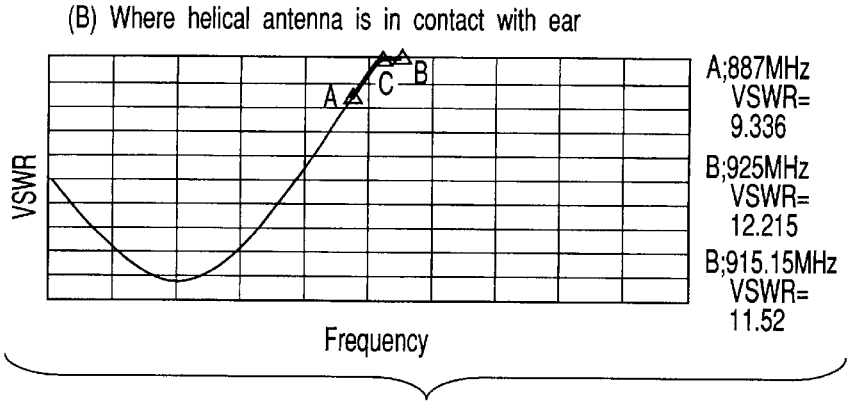
FIG. 12B is a graph indicating the VSWR characteristic assumed that a helical antenna touches the ear of a user.
Figure 13:
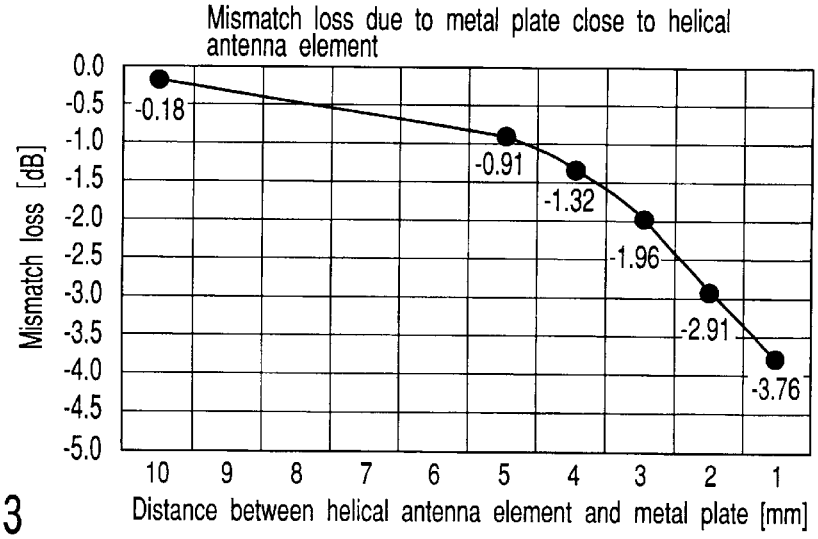
FIG. 13 is a graph indicating the result of a simulation concerning the degree of mismatch loss that occurs, in accordance with changes in the central frequency of a helical antenna, when a metal plate is made to be close to the element of the helical antenna.

In the case of the conventional helical antenna 2 shown in FIG. 11, if the cap 23 touches an ear 3 of a user during a call, the distance between the antenna element 22 and the ear 3 is as short as W2, which corresponds to the thickness of the wall of the cap 23, as is shown in FIG. 3. Accordingly, the conventional helical antenna 2 is significantly influenced by the body of the user, and therefore the characteristic of the antenna is degraded.

Figure 5:
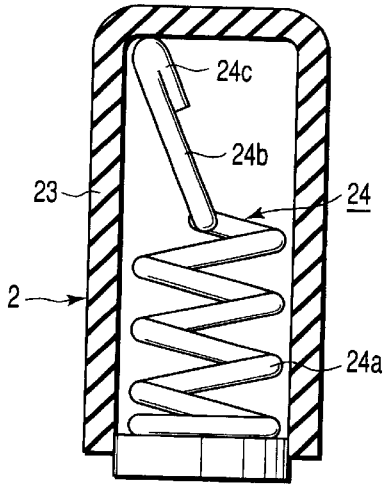
FIG. 5 PRIOR ART
FIG. 5 is a longitudinal cross-section view useful in explaining the problem of the conventional helical antenna.

If the cap 23 has no inclined portion (conical portion) 25*a*, as shown in FIG. 5, it may be possible that the top end of the linear portion 24*b* positions at a corner of the cap 23. In this case, if the cap 23 touches the ear 3 of a user during a call, the distance between the linear portion 24*b* of the antenna element 24 and the ear 3 of a user is as short as W2, which corresponds to the thickness of the wall of the cap 23. Accordingly, also in this case, the helical antenna 2 is significantly influenced by the body of the user, and therefore the characteristic of the antenna is degraded.

Moreover, in the above embodiment, since the bent portion 24*c* is provided at the top end of the linear portion 24*b* of the antenna element 24, when the cap 25 covers the antenna element 24, the linear portion 24*b* can be smoothly guided, by the inner surface of the conical portion 25*a*, to the center of the cap 25. Thus, the bent portion 24*c* enables more accurate and smooth positioning of the antenna element 24.

Figure 6:
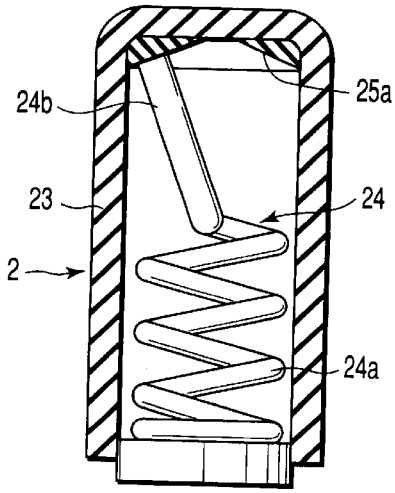
FIG. 6 PRIOR ART
FIG. 6 is a longitudinal cross-section view useful in explaining a problem that may occur in case that the conventional helical antenna does not have a bent portion.

If, on the other hand, the top end of the linear portion 24*b* of the antenna element 24 has no bent portion 24*c*, the top end of the linear portion 24*b* may be stuck to the portion of the conical portion (inclined portion) 25*a* other than the center when the cap 25 covers the antenna element 24, as is shown in FIG. 6.

(Second Embodiment)

Figure 7A:
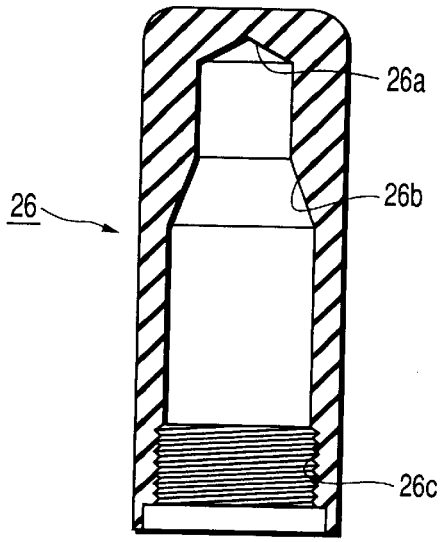
FIG. 7A is a longitudinal cross-section view illustrating the structure of a cap employed in the helical antenna according to a second embodiment of the invention.
Figure 7B:
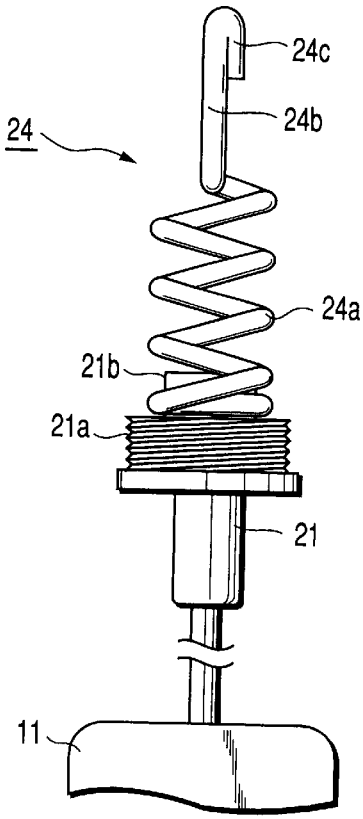
FIG. 7B is a longitudinal view illustrating the structure of an antenna element employed in the helical antenna according to the second embodiment of the invention.

FIG. 7A is a longitudinal cross-section view illustrating the structure of a cap 26 employed in a helical antenna according to a second embodiment of the invention. FIG. 7B is a longitudinal view illustrating the structure of an antenna element 24 employed in the helical antenna according to the second embodiment of the invention. In FIGS. 7A and 7B, elements similar to those in FIGS. 1A and 1B are denoted by corresponding reference numerals.

The element holder 21 comprises an element attachment portion 21*b*, and a cap fixing portion 21*a* with a thread groove formed in its outer cylindrical surface. The antenna element 24 comprises a helical portion 24*a*, a linear portion 24*b* extending from the helical portion 24*a* along a screw axis of the helix, and a bent portion 24*c* formed by bending the top end of the linear portion 24*b*. The bottom end of the helical portion 24*a* is attached, using the elasticity of the bottom end, to the element attachment portion 21*b* of the element holder 21.

The cap 26 has a cylindrical body with a closed upper end and open lower end. The upper inner surface portion of the cylindrical body is formed into a first inclined portion (conical portion) 26*a*. Further, the middle upper portion of the cylindrical body is formed into a second inclined portion 26*b* in which the inner diameter is reduced from below to above.

The first inclined portion 26*a* serves to guide the linear portion 24*b* of the antenna element 24 to the center of the upper inner surface portion of the cap 26, and to hold the top end of the linear portion 24*b* on the center, when the cap 26 covers the antenna element 24. On the other hand, the second inclined portion 26*b* serves to guide the linear portion 24*b* of the antenna element 24 to the first inclined portion 26*a*, when the cap 26 covers the antenna element 24.

A thread groove 26*c* is formed in the inner surface of the bottom end of the cylindrical body. The thread groove 26*c* is engaged with the thread groove of the cap fixing portion 21*a* of the antenna holder 21, when the cap 26 covers the antenna element 24.

In the above structure, when the cap 26 covers the antenna element 24, the top end of the linear portion 24*b* of the antenna element 24 is first guided to the first inclined portion 26*a* by the second inclined portion 26*b*, and is then guided to the center of the first inclined portion 26*a* by the first inclined portion 26*a* itself. At the center of the first inclined portion 26*a*, the top end of the antenna element 24 is held by pressure from below to above.

In other words, the linear portion 24*b* of the antenna element 24 is guided to the center of the cap 26 in two stages by the first and second is inclined portions 26*a* and 26*b*, and is held on the center of the first inclined portions 26*a*. Thus, the antenna element 24 is positioned more smoothly and accurately.

Figure 8:
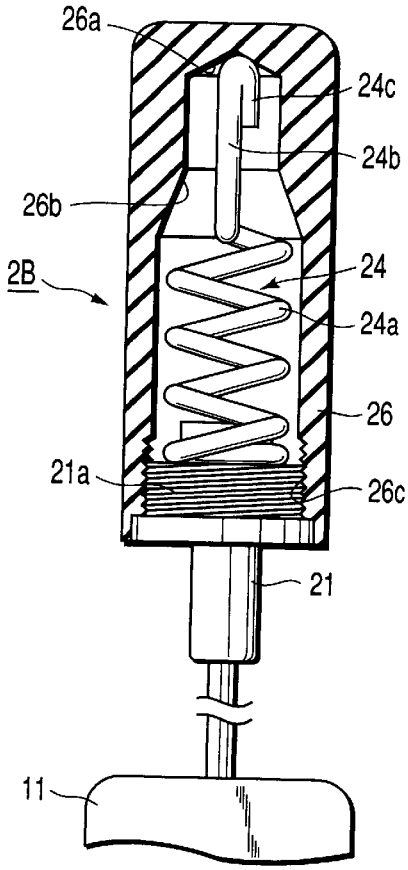
FIG. 8 is a longitudinal cross-section view illustrating a state in which the cap covers the antenna element in the helical antenna of FIGS. 7A and 7B.

FIG. 8 is a longitudinal cross-section view illustrating a state in which the cap covers the antenna element. As is evident from this figure, the linear portion 24*b* of the antenna element 24 is positioned at the center of the cap 26 in a reliable manner when the cap 26 covers the antenna element 24. Accordingly, even if a user makes a call with the cap 26 of the helical antenna 2B kept in contact with their ear 3, the linear portion 24*b* of the antenna element 24 is kept away from the ear by a distance that corresponds to the radius of the cap 26. Further, there is little possibility of a change in the position of the antenna element 24 within the cap 26 due to, for example, vibration of the portable terminal casing 1. Thus, the influence of the body of a user upon the antenna element 24 is minimized, thereby maintaining a good characteristic of the antenna.

(Other Embodiments)

Figure 9:
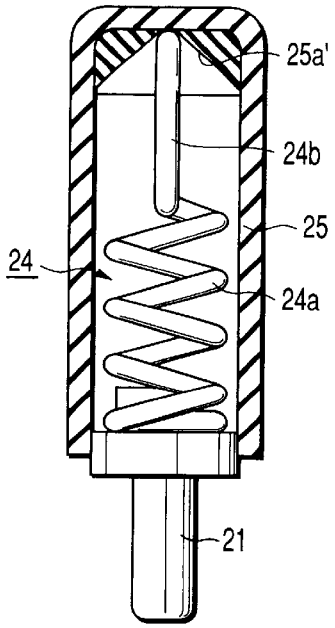
FIG. 9 is a longitudinal cross-section view illustrating a helical antenna according to another embodiment of the invention, where the top end of the linear portion of the helical antenna is shaped like a hemisphere.

In the first embodiment, the bent portion 24*c* is provided at the top end of the linear portion 24*b* of the antenna element 24. However, if the inclination angle of the inclined portion is set large as in the case of the inclined portion 25*a*' shown in FIG. 9, the bent portion 24*c* can be dispensed with. As shown in FIG. 9, since the top end of the linear portion 24*b* is planed off, the top end of the linear portion 24*b* is shaped like a hemisphere.

Figure 10:
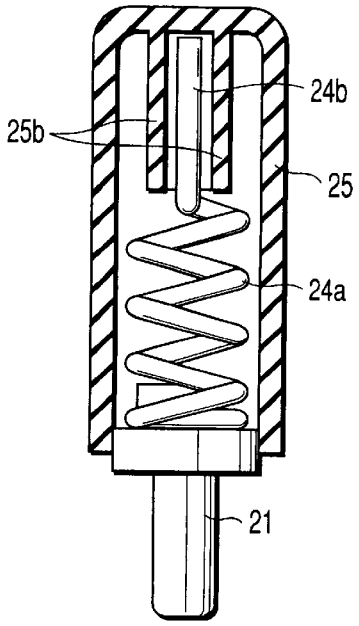
FIG. 10 is a longitudinal cross-section view illustrating a helical antenna according to yet another embodiment of the invention.

Furthermore, the linear portion 24*b* of the antenna element 24 may be positioned in a cylindrical guide projection 25*b* inwardly projecting from the upper inner surface portion of the cap 25, as is shown in FIG. 10.

In addition, for smooth insertion and positioning of the antenna element, it is very effective to make coating on the surface of each inclined portion of the cap so as to further reduce the friction coefficient of the inner surface of the cap.

As described above, in the embodiments of the present invention, the linear portion of the antenna element can be reliably positioned along a screw axis of the helical portion, thereby enabling the top end of the antenna element to be kept away from the ear of a user by a distance that corresponds to the radius of the cap. In addition, there is little possibility of a change in the position of the antenna element within the cap due to, for example, vibration of the portable terminal casing. As a result, the influence of a human body upon the antenna element is minimized, thereby maintaining a good characteristic of the antenna.

The embodiments of the present invention are also characterized in that the element-position holding portion is constructed as below. In a first structure, the upper inner surface portion of the cap is formed into a conical portion (inclined portion). In a second structure, the upper inner surface portion of the cap is formed into a conical portion (first inclined portion), and the upper side surface of the cap is formed into a second inclined portion for guiding the linear portion of the antenna element to the first inclined portion.

In the first structure in which the conical inclined portion is formed, the cap itself and the inclined portion can be formed in a monolithic manner, which enables the cap to be produced at low cost without using any additional member. In the second structure in which the first and second inclined portions are provided, when the cap covers the antenna element, the linear portion of the antenna element can be reliably guided to the first inclined portion by the second inclined portion. Therefore, the first and second inclined portion prevents the antenna element from being housed in the cap and deformed.

The embodiments of the present invention are further characterized in that the top end of the linear portion of the antenna element is bent. The bent portion substantially prevents the top end of the linear portion of the antenna element from getting stuck on the inner surface of the cap, when the cap covers the antenna element. As a result, the linear portion of the antenna element can be guided to the inclined portion in a reliable manner.

As described above in detail, the bottom portion of the antenna element is formed into a helical portion, and the top portion is formed into a linear portion, the linear portion being positioned along a screw axis of the helical portion. Further, an element-position holding portion is formed at the, upper inner surface portion of the cap that is arranged to house the antenna element from the top end of the element. The element-position holding portion holds the linear portion of the antenna element along the screw axis of the helical portion.

By virtue of the above structure, an appropriate distance can be reliably secured between the antenna element and a human body. As a result, the embodiments of the present invention provide a helical antenna that can always exhibit a good characteristic and a portable communication terminal using the helical antenna.

The structure of the cap, mechanism for mounting the cap, the shape or structure of the element-position holding portion, the structure of the antenna element, the type of portable communication terminal, or the structure of the terminal may be modified in various ways without departing from the scope of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A helical antenna for use in a portable communication terminal containing a radio unit which transmits and receives a radio signal, comprising:

an antenna element connectable to the radio unit and containing a bottom portion formed into a helical portion and a top portion formed into a linear portion, the linear portion being positioned along a screw axis of the helical portion;

a cap housing the antenna element if the cap covers the antenna element from a top end of the antenna element; and a position portion provided in the cap, the position portion positioning the linear portion of the antenna element along the screw axis of the helical portion.

2. The helical antenna according to claim 1, wherein the position portion is an inclined portion formed at an upper inner surface portion of the cap and tapered toward a central portion of a top of the cap.

3. The helical antenna according to claim 1, wherein the position portion includes a first inclined portion formed at an upper inner surface portion of the cap and tapered toward a central portion of a top of the cap, and a second inclined portion formed at an inner side surface portion of the cap, the second inclined portion guiding the linear portion of the antenna element to the first inclined portion.

4. The helical antenna according to claim 1, wherein the linear portion of the antenna element contains a bent portion at a top end of the linear portion.

5. A portable communication terminal comprising:

a portable communication terminal casing which houses a radio transmitting and receiving circuit; and a helical antenna provided at an upper end of the portable communication terminal casing and connected to the radio transmitting and receiving circuit, the helical antenna comprising:

an antenna element containing a bottom is portion formed into a helical portion and a top portion formed into a linear portion, the linear portion being positioned along a screw axis of the helical portion;

a cap housing the antenna element if the cap covers the antenna element from a top end of the antenna element; and a position portion provided in the cap, the position portion positioning the linear portion of the antenna element along the screw axis of the helical portion.

6. The portable communication terminal according to claim 5, wherein the position portion is an inclined portion formed at an upper inner surface portion of the cap and tapered toward a central portion of a top of the cap.

7. The portable communication terminal according to claim 5, wherein the position portion includes a first inclined portion formed at an upper inner surface portion of the cap and tapered toward a central portion of a top of the cap, and a second inclined portion formed at an inner side surface portion of the cap, the second inclined portion guiding the linear portion of the antenna element to the first inclined portion.

8. The portable communication terminal according to claim 5, wherein the linear portion of the antenna element contains a bent portion at a top end of the linear portion.

9. A helical antenna for use in a portable communication terminal containing a radio unit which transmits and receives a radio signal, comprising:

an antenna element connectable to the radio unit and containing a bottom portion formed into a helical portion and a top portion formed into a linear portion, the linear portion extending to a screw axis of the helical portion;

a cap housing the antenna element; and a position portion provided in the cap, the position portion positioning the linear portion of the antenna element along the screw axis of the helical portion.

10. The helical antenna according to claim 9, wherein the cap houses the antenna element if the cap covers the antenna element from a top end of the antenna element.

11. The helical antenna according to claim 9, wherein the position portion is an inclined portion formed at an upper inner surface portion of the cap and tapered toward a central portion of a top of the cap.

12. The helical antenna according to claim 9, wherein the position portion includes a first inclined portion formed at an upper inner surface portion of the cap and tapered toward a central portion of a top of the cap, and a second inclined portion formed at an inner side surface portion of the cap, the second inclined portion guiding the linear portion of the antenna element to the first inclined portion.

13. The helical antenna according to claim 9, wherein the linear portion of the antenna element contains a bent portion at a top end of the linear portion.

14. A portable communication terminal comprising:

a portable communication terminal casing which houses a radio transmitting and receiving circuit; and a helical antenna provided at an upper end of the portable communication terminal casing and connected to the radio transmitting and receiving circuit, the helical antenna comprising:

an antenna element containing a bottom portion formed into a helical portion and a top portion formed into a linear portion, the linear portion extending to a screw axis of the helical portion;

a cap housing the antenna element; and a position portion provided in the cap, the position portion positioning the linear portion of the antenna element along the screw axis of the helical portion.

15. The portable communication apparatus according to claim 14, wherein the cap houses the antenna element if the cap covers the antenna element from a top end of the antenna element.

16. The portable communication terminal according to claim 14, wherein the position portion is an inclined portion formed at an upper inner surface portion of the cap and tapered toward a central portion of a top of the cap.

17. The portable communication terminal according to claim 14, wherein the position portion includes a first inclined portion formed at an upper inner surface portion of the cap and tapered toward a central portion of a top of the cap, and a second inclined portion formed at an inner side surface portion of the cap, the second inclined portion guiding the linear portion of the antenna element to the first inclined portion.

18. The portable communication terminal according to claim 14, wherein the linear portion of the antenna element contains a bent portion at a top end of the linear portion.

* * * * *